US010272486B2

(12) United States Patent
Sun

(10) Patent No.: US 10,272,486 B2
(45) Date of Patent: Apr. 30, 2019

(54) FIXING GUN AND LOADING DEVICE THEREOF

(71) Applicants: LITE-ON ELECTRONICS (GUANGZHOU) LIMITED, Guangzhou (CN); LITE-ON TECHNOLOGY CORP., Taipei (TW)

(72) Inventor: Cheng-Chi Sun, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 401 days.

(21) Appl. No.: 15/161,426

(22) Filed: May 23, 2016

(65) Prior Publication Data

US 2017/0182546 A1 Jun. 29, 2017

(30) Foreign Application Priority Data

Dec. 23, 2015 (CN) ..... 2015 1 0991949

(51) Int. Cl.
*B25B 19/00* (2006.01)
*B21J 15/32* (2006.01)
(Continued)

(52) U.S. Cl.
CPC ..... *B21J 15/32* (2013.01); *B21J 15/105* (2013.01); *B21J 15/18* (2013.01)

(58) Field of Classification Search
CPC ..... B25C 1/003; B25C 1/005; B25C 1/006; B25C 1/04; B25C 1/048; B25C 5/1627; B25C 1/047; B25C 1/188; B25B 21/026; B25B 28/00; B25B 23/1405; B25B 23/1475; B25B 19/00; B25B 21/02; B23Q 5/26; B23Q 5/22; B23Q 5/263; B23Q 5/165; B23Q 5/06
USPC ..... 227/120, 113, 137, 15, 116, 138; 29/243.523, 243.53, 243.56; 81/464, 463, 81/465, 466
See application file for complete search history.

(56) References Cited

U.S. PATENT DOCUMENTS

2010/0192737 A1* 8/2010 Hsieh ..... B25B 19/00 81/466
2010/0252607 A1* 10/2010 Forrest ..... B25C 1/04 227/8
2013/0320066 A1* 12/2013 Gregory ..... B25C 1/001 227/126

FOREIGN PATENT DOCUMENTS

EP 0750954 A1 * 1/1997 ..... B21J 15/105
EP 0750954 A1 * 1/1997 ..... B21J 15/105

OTHER PUBLICATIONS

See attached translation. 1997.*

* cited by examiner

*Primary Examiner* — Monica S Carter
*Assistant Examiner* — Abbie E Quann
(74) *Attorney, Agent, or Firm* — Rosenberg, Klein & Lee

(57) ABSTRACT

A fixing gun includes a gun body and a loading device. The gun body is for manipulation of a fastener, and has a loading hole. The loading device includes a guide member and a linkage mechanism. The guide member is formed with a first guide groove and a second guide groove. The linkage mechanism includes a lower link, a slide member, and a clamp assembly for holding the fastener. The slide member is disposed movably on the guide member. The lower link is pivoted to the slide member and the clamp assembly. During movement of the slide member relative to the guide member for moving the fastener into the loading hole, the lower link is alternatively engaged to the first guide groove and the second guide groove.

13 Claims, 17 Drawing Sheets

(51) Int. Cl.

| | |
|---|---|
| ***B21J 15/10*** | (2006.01) |
| *B21J 15/18* | (2006.01) |

FIXING GUN AND LOADING DEVICE THEREOF

CROSS-REFERENCE TO RELATED APPLICATION

This application claims priority of Chinese Application No. 201510991949.7, filed on Dec. 23, 2015.

FIELD

The invention relates to a fixing gun, and more particularly to a fixing gun including a loading device.

BACKGROUND

A conventional fixing gun is for manipulation of a fastener, such as a solid rivet or a blind rivet. After the manipulation of the fastener, a user needs to manually reload the conventional fixing gun with another fastener. Such operation is inconvenient and time-consuming. Additionally, the reloaded fastener may be inaccurately positioned in the conventional fixing gun due to the manual operation.

SUMMARY

According to one embodiment of the present invention, a fixing gun is provided. The fixing gun includes a gun body and a loading device. The gun body is for manipulation of a fastener, and has a loading hole. The loading device is disposed on the gun body for moving the fastener into the loading hole, and includes a guide member and a linkage mechanism. The guide member is formed with a first guide groove and a second guide groove. The linkage mechanism includes a lower link, a slide member, and a clamp assembly for holding the fastener. The slide member is disposed movably on the guide member. The lower link is pivoted to the slide member and the clamp assembly. During movement of the slide member relative to the guide member for moving the fastener into the loading hole, the lower link is alternatively engaged to the first guide groove and the second guide groove.

According to another embodiment of the present invention, a loading device is provided. The loading device includes a guide member and a linkage mechanism. The guide member is formed with a first guide groove and a second guide groove. The linkage mechanism is movable relative to the guide member, and includes a lower link. The lower link includes a first pin and a second pin. The first and second pins are respectively and separably engageable with the first and second guide grooves. During movement of the linkage mechanism relative to the guide member, the second pin is separated from the second guide groove when the first pin engages the first guide groove, and the first pin is separated from the first guide groove when the second pin engages the second guide groove.

BRIEF DESCRIPTION OF THE DRAWINGS

Other features and advantages of the invention will become apparent in the following detailed description of the embodiment with reference to the accompanying drawings, of which.

DETAILED DESCRIPTION

Figure 1:
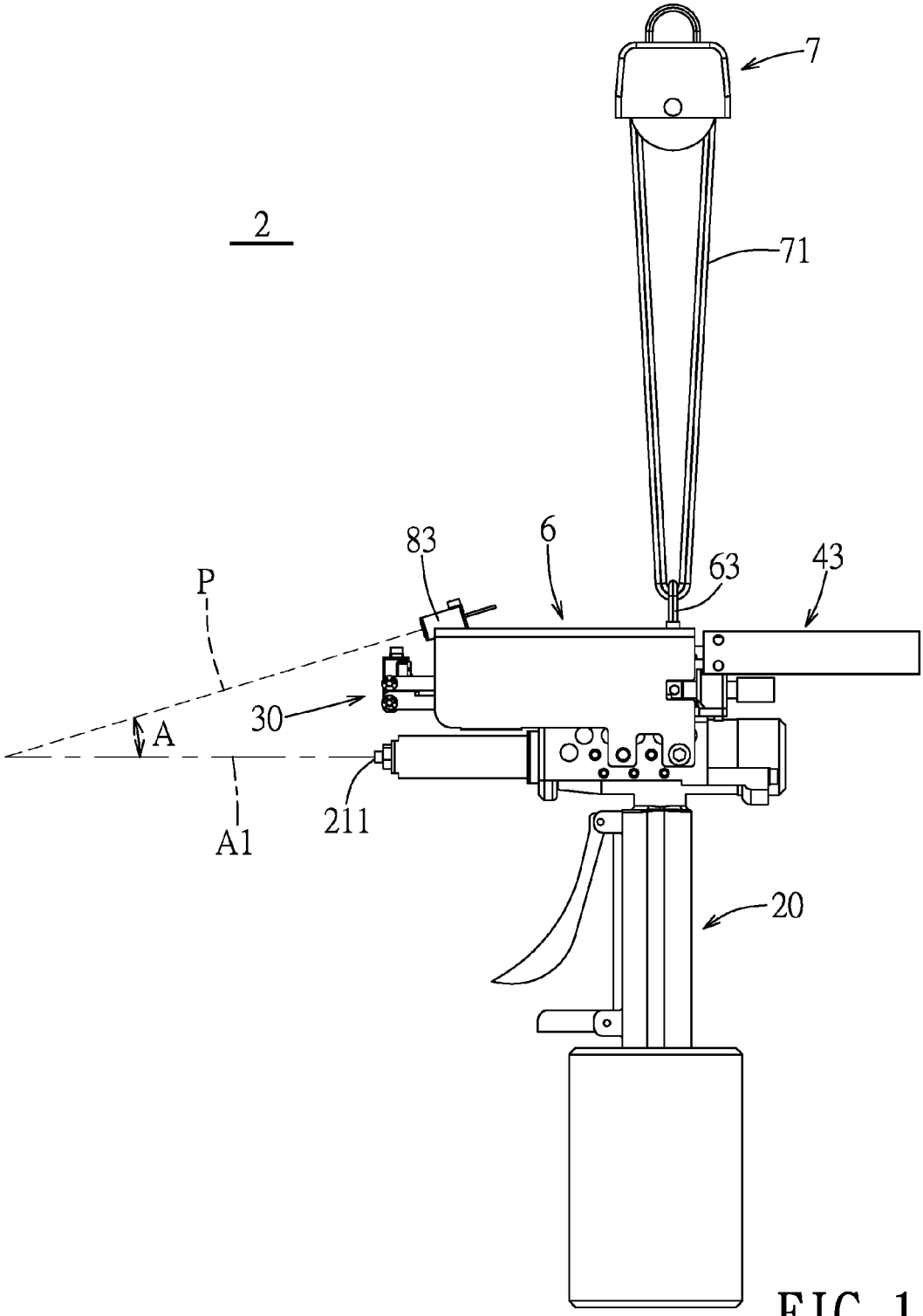
FIG. 1 is a side view illustrating a fixing gun according to an embodiment of the invention.

Before the invention is described in greater detail, it should be noted that where considered appropriate, reference numerals or terminal portions of reference numerals have been repeated among the figures to indicate corresponding or analogous elements, which may optionally have similar characteristics.

Figure 2:
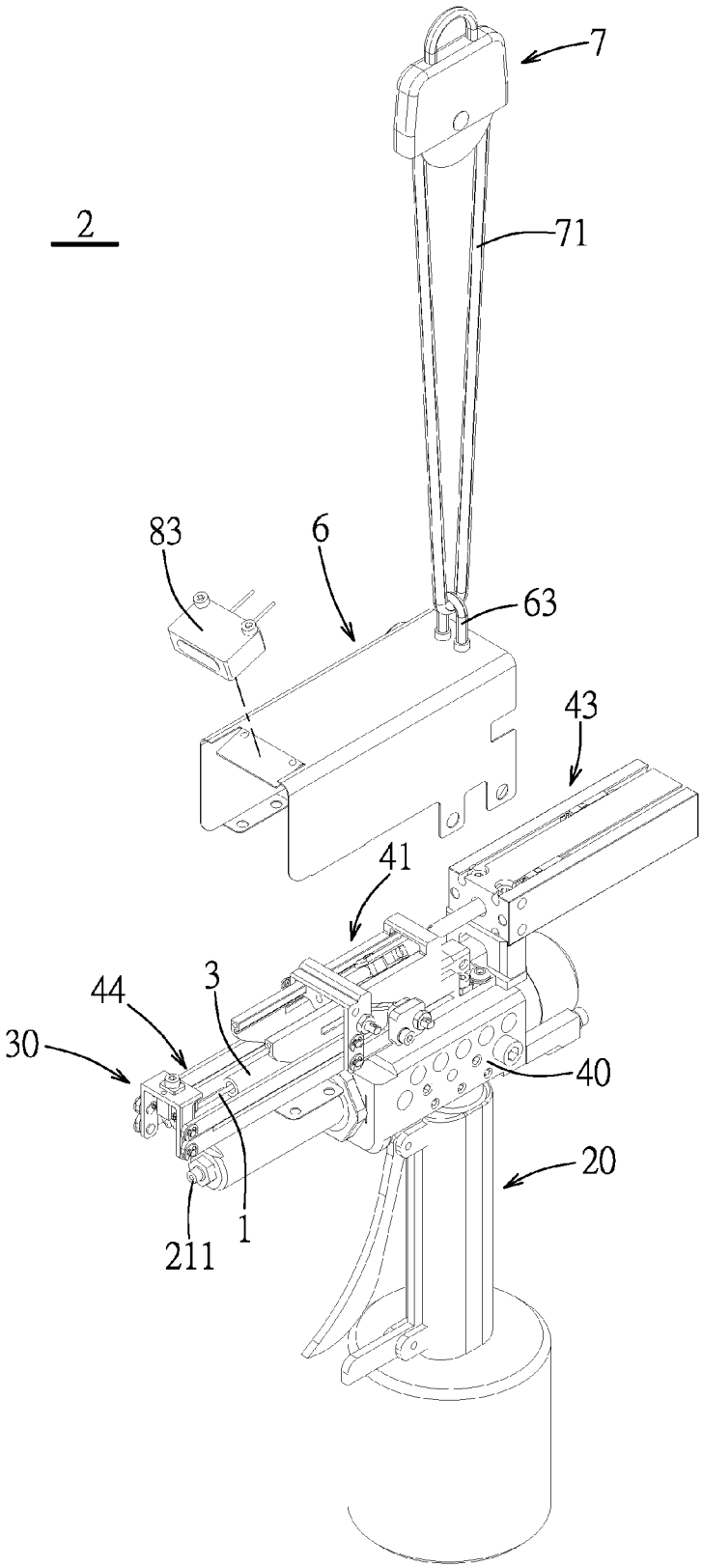
FIG. 2 is a partly exploded perspective view of the fixing gun shown in FIG. 1.

Referring to FIGS. 1 and 2, FIGS. 1 and 2 are respectively a side view and a partly exploded perspective view of a fixing gun 2 according to an embodiment of the invention. In the embodiment, the fixing gun 2 is for manipulation of a fastener 1 to fasten elements together by such as a solid rivet or a blind rivet. The fixing gun 2 includes a gun body 20, and a loading device 30 that is disposed on the gun body 20. The gun body 20 has a loading hole 211 that permits the fastener 1 to be inserted thereinto. The loading device 30 includes a feed tube 3, a base seat 40, a guide member 41, a drive unit 43 and a linkage mechanism 44.

Figure 3:
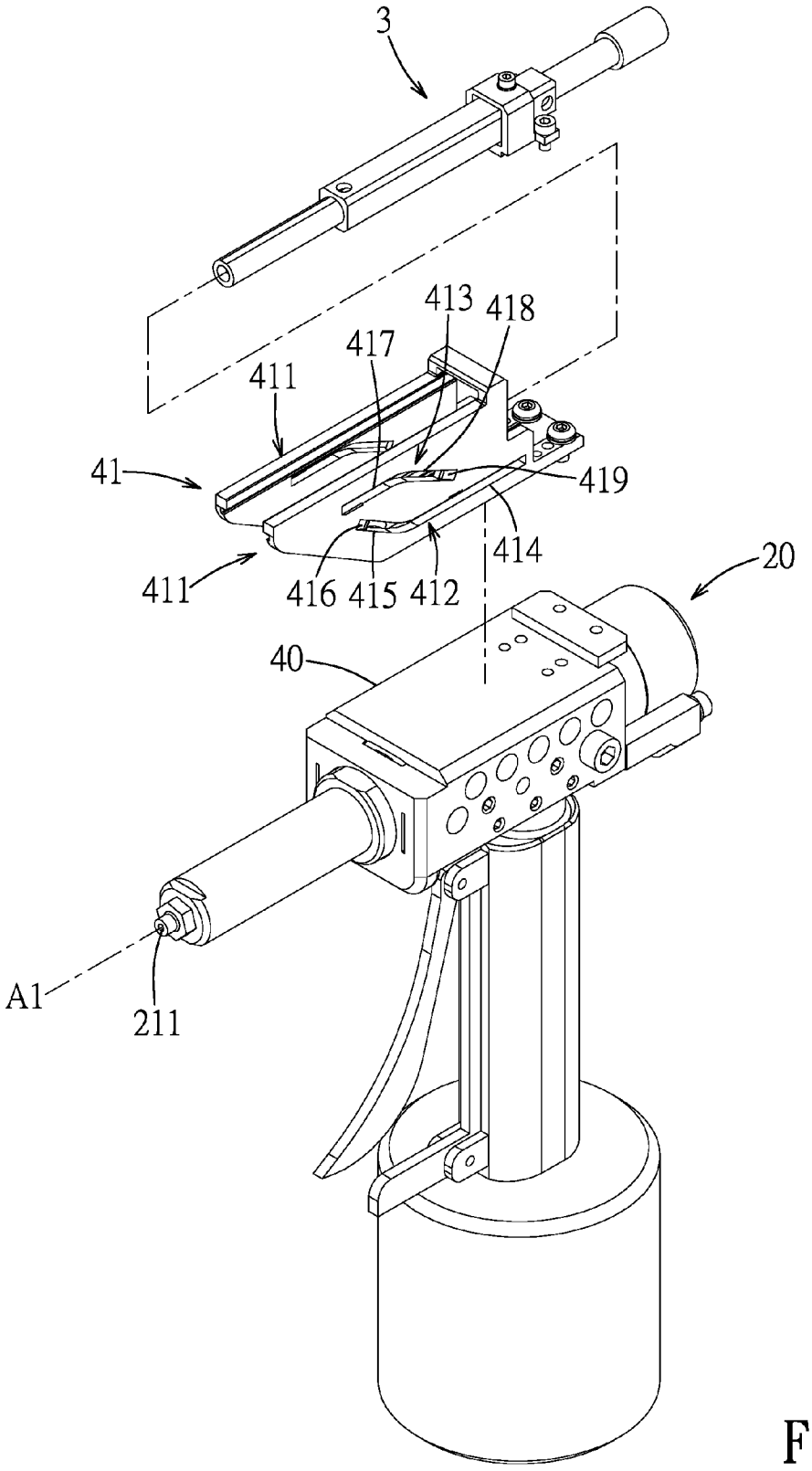
FIG. 3 is a partly exploded perspective view illustrating a gun body, a base seat, a guide member and a feed tube of the embodiment.

Referring further to FIG. 3, FIG. 3 is a partly exploded perspective view illustrating the gun body 20, the base seat 40, the guide member 41 and the feed tube 3 of the embodiment. The base seat 40 is disposed on the gun body 20. The guide member 41 is disposed on the base seat 40, and has two space-apart lateral plates 411 that are parallel to each other. Each of the lateral plates 411 is formed with a first guide groove 412 and a second guide groove 413 that are spaced apart from each other and that are not connected with each other. The first and second guide grooves 412, 413 are formed through the corresponding lateral plate 411. In one embodiment, the first and second guide grooves 412, 413 are machined by wire cutting.

Each of the first guide grooves 412 has a first horizontal groove portion 414, and a first inclined groove portion 415 that extends forwardly and upwardly from a front end of the first horizontal groove portion 414. Each of the second guide grooves 413 has a second horizontal groove portion 417, and a second inclined groove portion 418 that extends rearwardly and downwardly from a rear end of the second horizontal groove portion 417. The second horizontal groove portion 417 of each of the second guide grooves 413 is located above and spaced apart from the first inclined groove portion 415 of the corresponding first guide groove 412, and is parallel to the first horizontal groove portion 414 of the corresponding first guide groove 412. The first guide groove 412 has a first guide surface 416 that is formed and located at a distal end of the first inclined groove portion 415, and the corresponding second guide groove 413 has a second guide surface 419 that is formed and located at a distal end of the second inclined groove portion 418.

Figure 4:
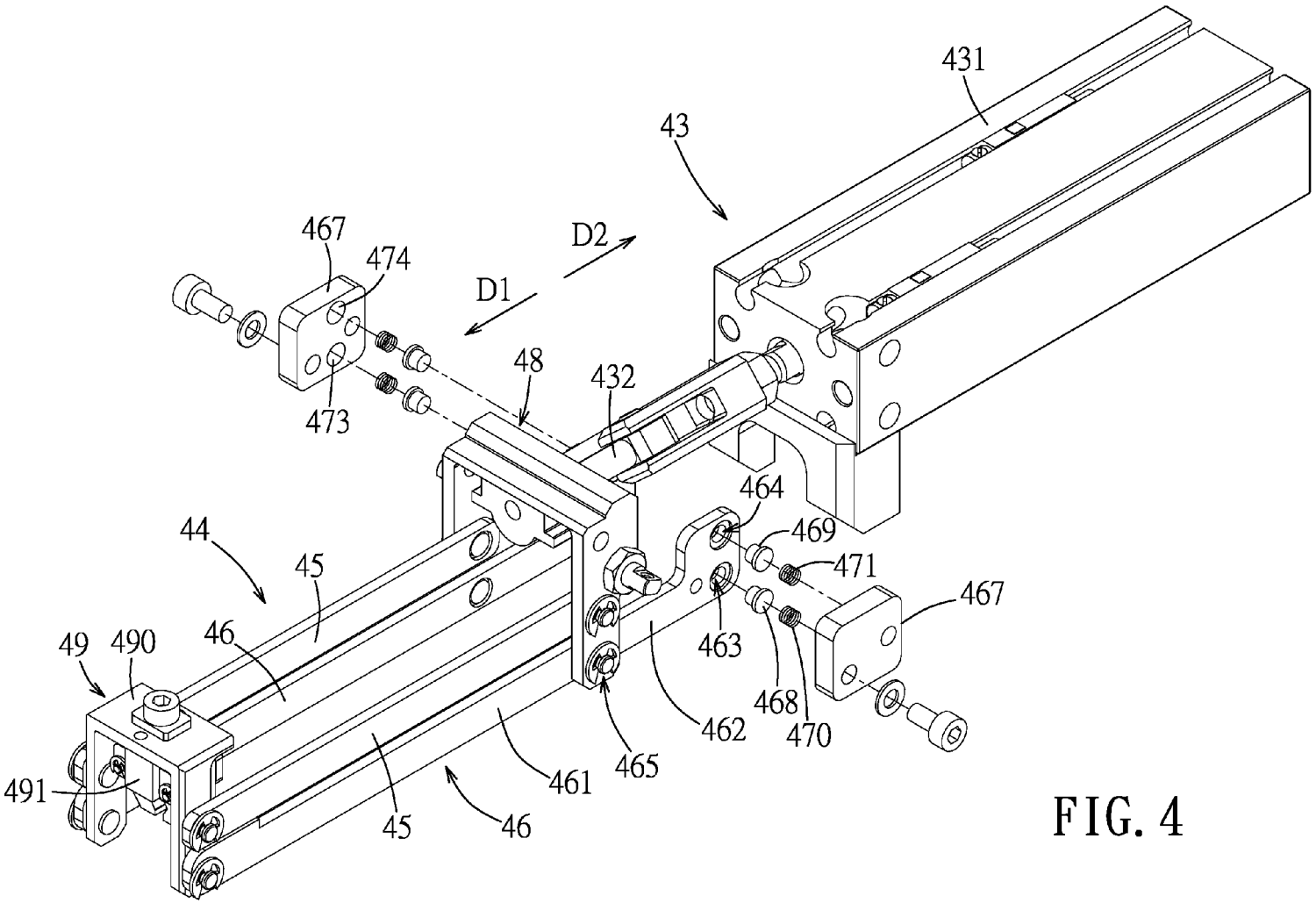
FIG. 4 is a partly exploded perspective view illustrating a drive unit and a linkage mechanism of the embodiment.

Referring to FIG. 4, FIG. 4 is a partly exploded perspective view illustrating the drive unit 43 and the linkage mechanism 44 of the embodiment. The drive unit 43 is configured as a pneumatic cylinder, and includes a cylinder body 431 and a rod 432. The linkage mechanism 44 includes a pair of upper links 45, a pair of lower links 46, a slide member 48 and a clamp assembly 49. The upper links 45 are respectively located at two opposite lateral sides of the guide member 41. The lower links 46 are respectively located at the two opposite lateral sides of the guide member 41. Each of the lower links 46 is spaced apart from and located under the corresponding upper link 45, and is substantially parallel to the corresponding upper link 45. Each of the lower links 46 has a length greater than that of the corresponding upper links 45.

The slide member 48 is movably disposed on the lateral plates 411 of the guide member 41, and is connected to the rod 432 of the drive unit 43, such that the drive unit 43 is operable to move the slide member 48 in two opposite first and second directions (D1, D2) so as to drive movement of the linkage mechanism 44. The clamp assembly 49 includes a mount frame 490. Each of the upper links 45 is pivoted to the mount frame 490 and the slide member 48. Each of the lower links 46 is pivoted to the mount frame 490 and the slide member 48. The lower link 46 is divided into a first lower link section 461 and a second lower link section 462 by a pivot bolt 465 via which the lower link 46 is pivoted to the slide member 48. The first lower link section 461 of the lower link 46 is parallel to the corresponding upper link 45, and is identical to the corresponding upper link 45 in length. As such, each of the upper links 45 cooperates with the corresponding lower link 46, the slide member 48 and the mount frame 490 of the clamp assembly 49 to constitute a parallel four-bar linkage. The second lower link section 462 of the lower link 46 extends rearwardly from the first lower link section 461 of the corresponding lower link 46, and is formed with a first through hole 463 and a second through hole 464.

Figure 5:
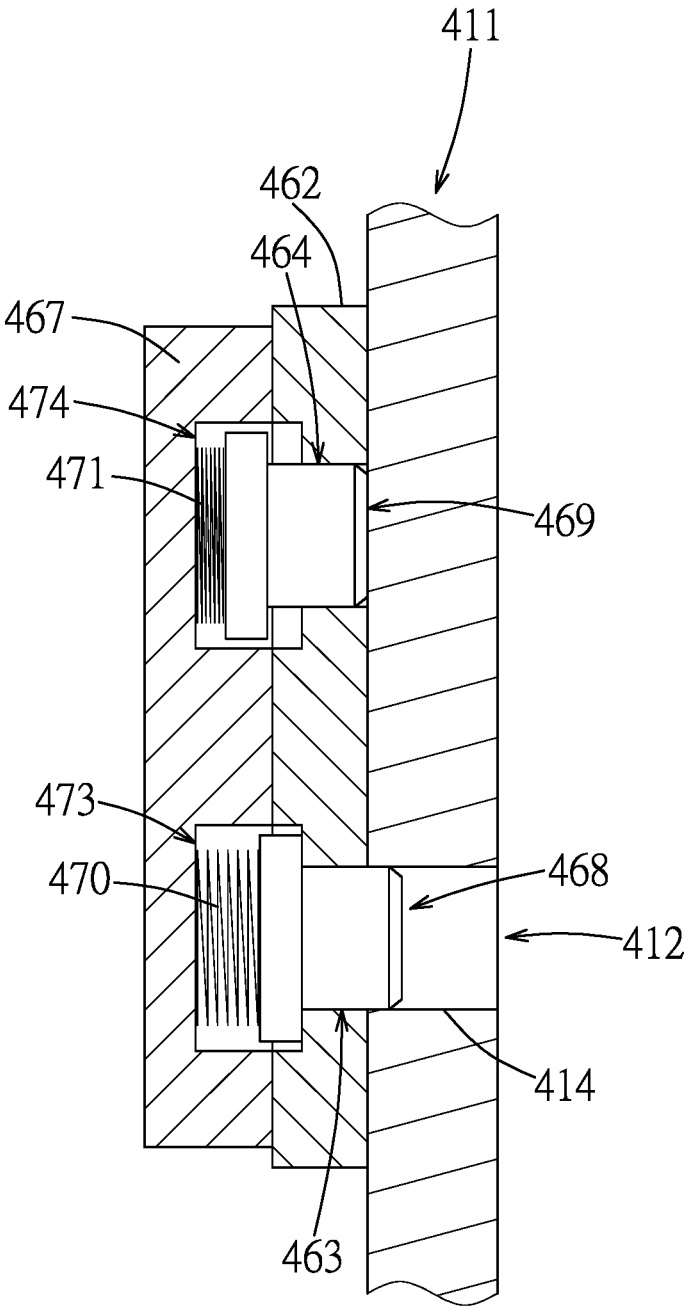
FIG. 5 is a fragmentary sectional view illustrating a lateral plate of the guide member and a second lower link section of a lower link of the embodiment.

Referring further to FIG. 5, FIG. 5 is a fragmentary sectional view illustrating the second lower link section 462 of the lower link 46 and the corresponding lateral plate 411 of the guide member 41. The lower link 46 has a connecting plate 467 that is disposed on the second lower link section 462 and that is formed with a first blind hole 473 and a second blind hole 474 for respectively retaining first and second resilient members 470, 471, and first and second pins 468, 469. In the embodiment, the first and second pins 468, 469 are respectively and partially retained in the first and second blind holes 473, 474, and respectively and movably extend through the first and second through holes 463, 464 of the second lower link section 462 of the lower link 46.

For the sake of brevity, only one of the lower links 46 and the corresponding lateral plate 411 of the guide member 41 are described in the following paragraphs. In one embodiment, the first and second pins 468, 469 of the lower link 46 are respectively and separably engageable with the first and second guide grooves 412, 413 formed in the lateral plate 411. During operation of the linkage mechanism 44, the first and second pins 468, 469 of the lower link 46 will be alternatively engaged with the corresponding first and second guide grooves 412, 413 of the lateral plate 411. For example, when the linkage mechanism 44 is in a state shown in FIG. 5, the first pin 468 is aligned with the first guide groove 412 and the second pin 469 is not aligned with the second guide groove 413. At this time, the first pin 468 is biased by the first resilient member 470 to engage the first guide groove 412 such that the lower link 46 is engaged to the first guide groove 412 via the first pin 468. Since the second pin 469 is not aligned with the second guide groove 413, the second pin 469 is biased by the second resilient member 471 to abut against a side surface of the lateral plate 411.

Figure 6:
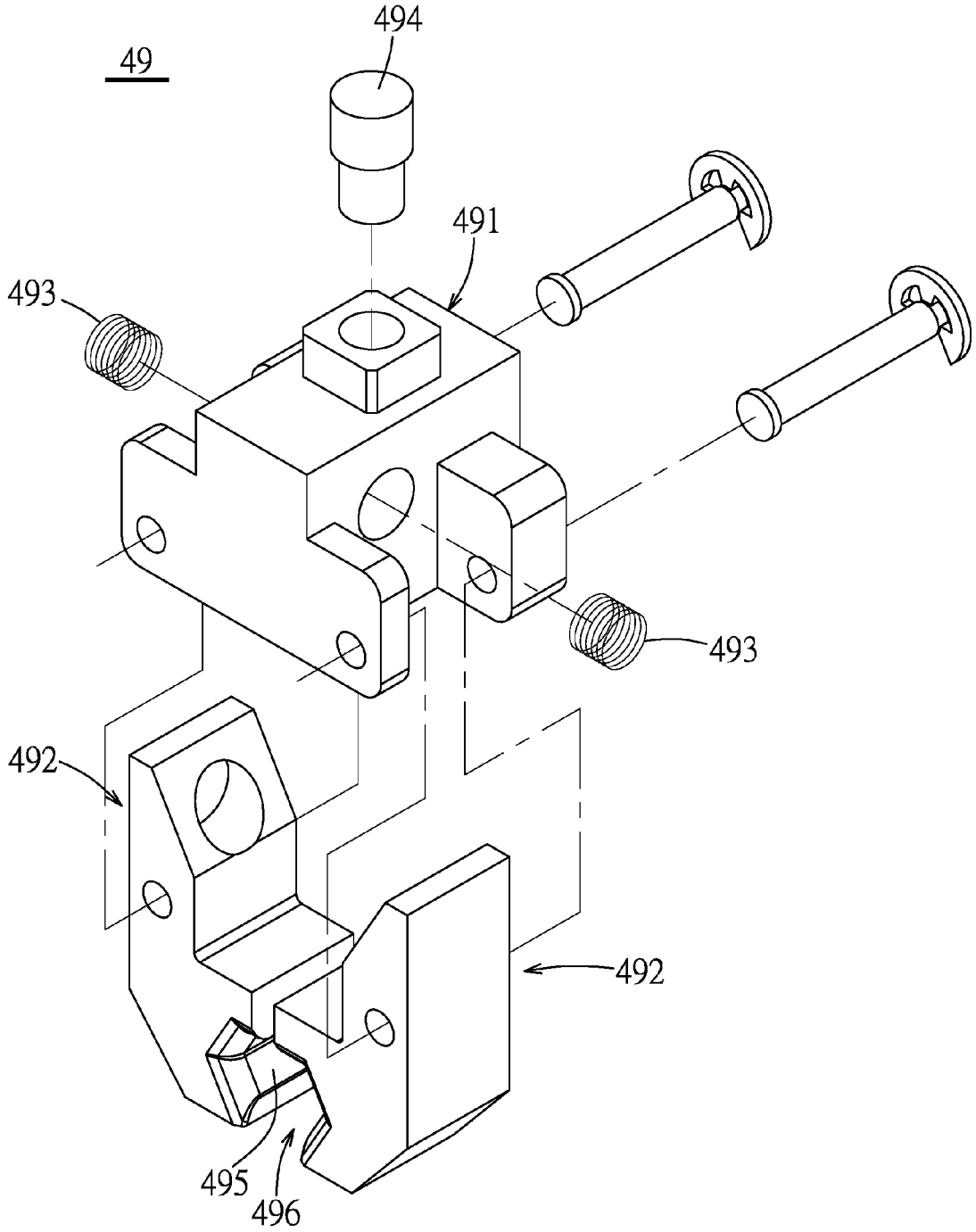
FIG. 6 is an exploded perspective view illustrating a clamp assembly of the embodiment.
Figure 7:
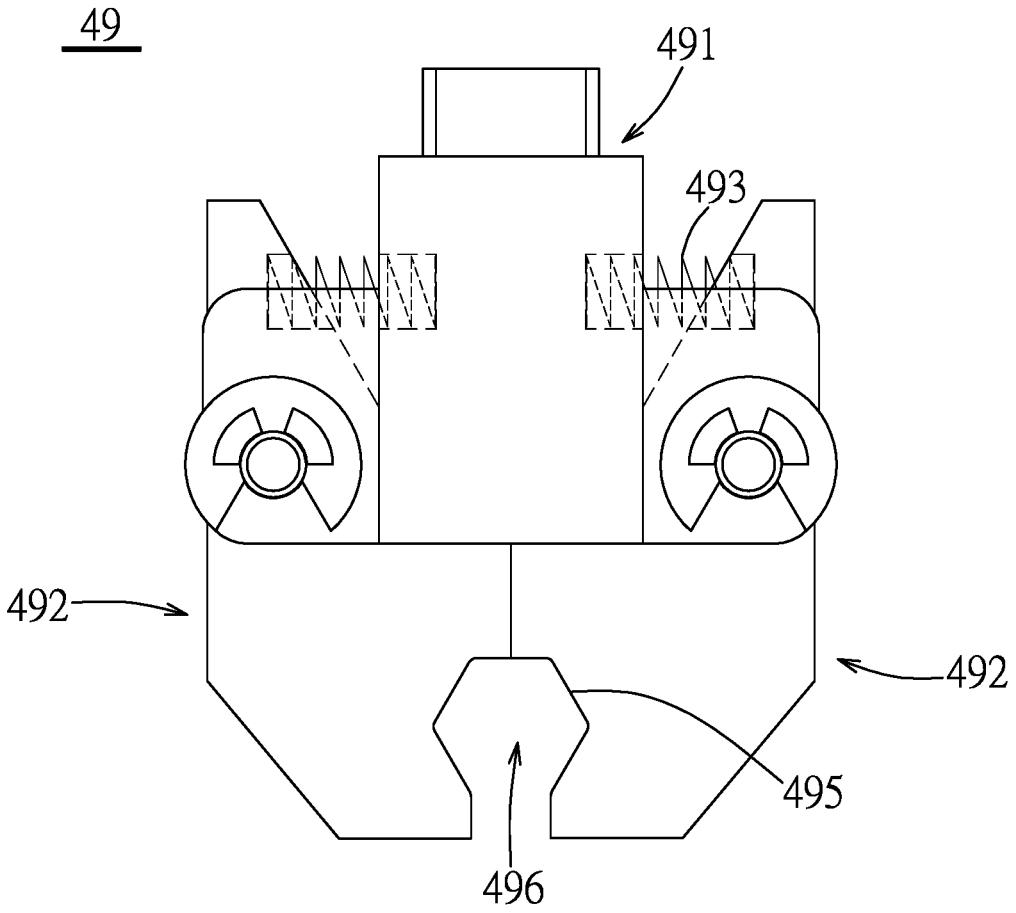
FIG. 7 is a front view illustrating the clamp assembly of the embodiment.

Referring further to FIGS. 6 and 7, FIG. 6 is an exploded perspective view of the clamp assembly 49, and FIG. 7 is a front view of the clamp assembly 49. The clamp assembly 49 further includes a seat member 491, two claw members 492 and two resilient members 493. The seat member 491 is fixed to the mount frame 490 by a bolt 494. The claw members 492 are pivoted to the seat member 491. Each of the claw members 492 has a clamping surface 495 at an end portion thereof. The clamping surfaces 495 of the claw members 492 cooperatively define a polygonal clamping space 496 therebetween for partially retaining the fastener 1. Each of the resilient members 493 is disposed between the seat member 491 and a respective one of the claw members 492, and resiliently biases another end portion of the corresponding claw member 492 opposite to the clamping surface 495, such that the clamping surfaces 495 of the claw members 492 are moved toward each other.

The operation of the linkage mechanism 44 of the fixing gun 2 is described as follows.

Figure 8:
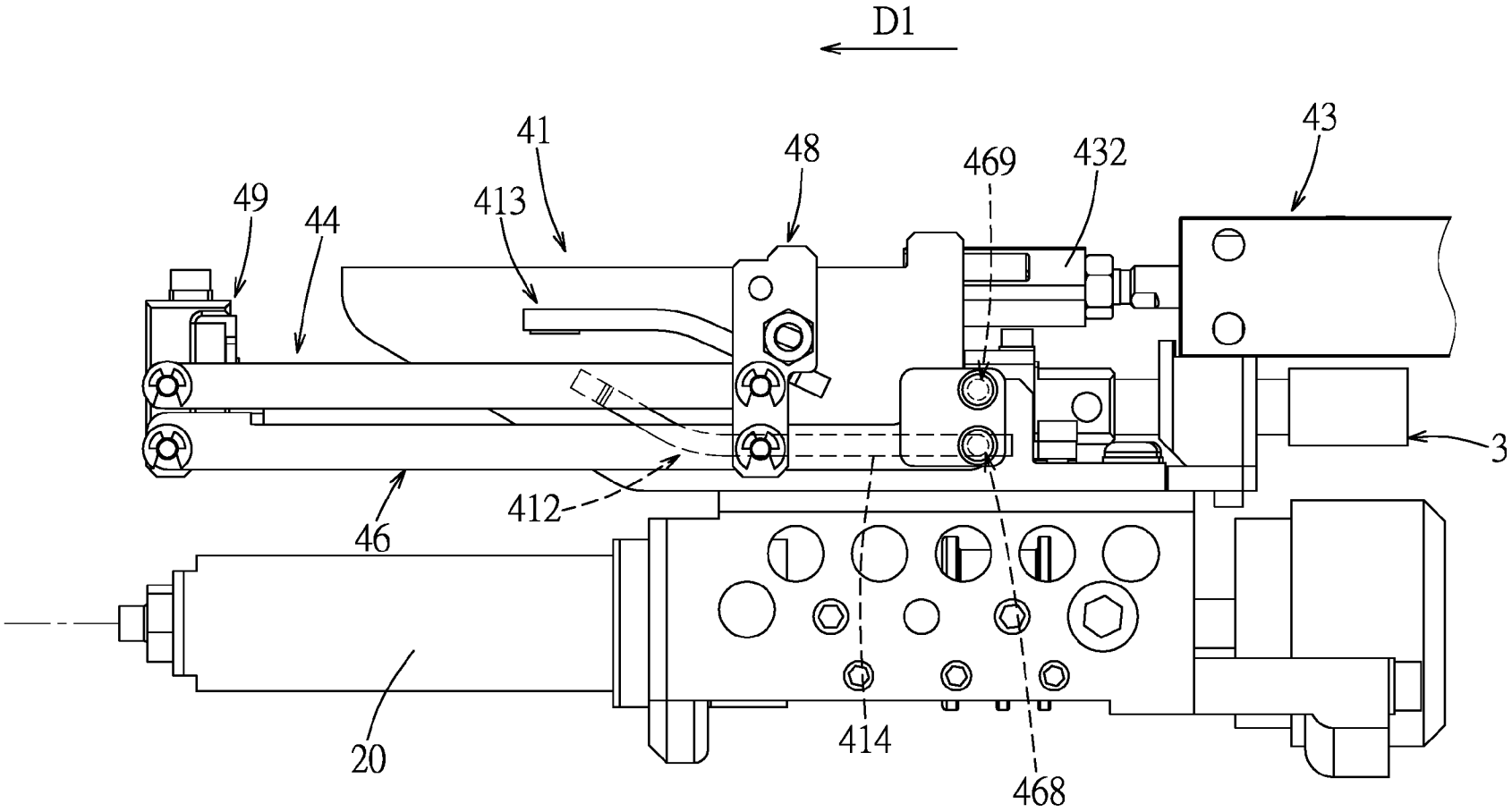
FIG. 8 is a schematic fragmentary side view illustrating the linkage mechanism at an initial position.
Figure 9:
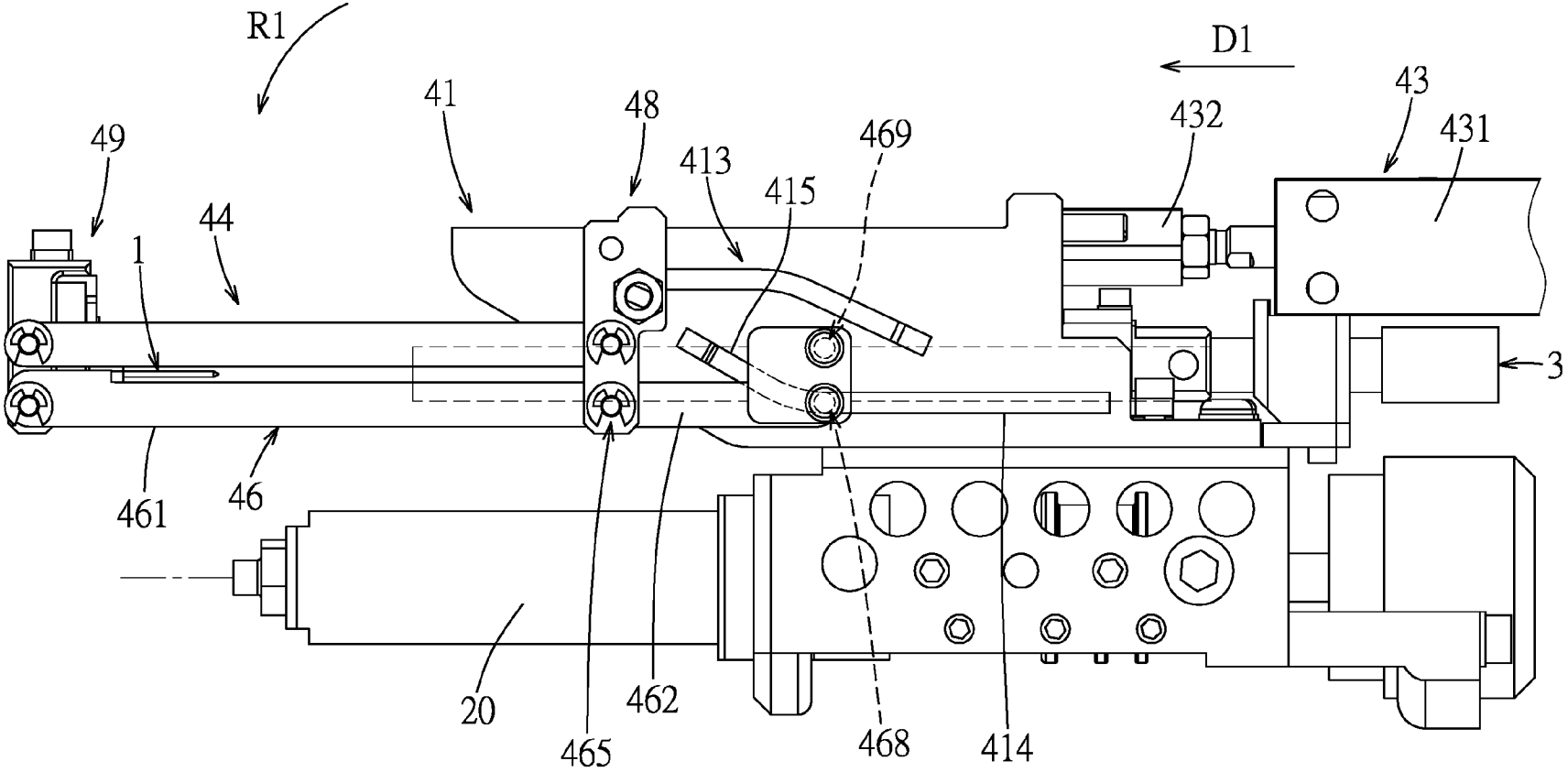
FIG. 9 is a schematic fragmentary side view illustrating the linkage mechanism at a first turning position.
Figure 10:
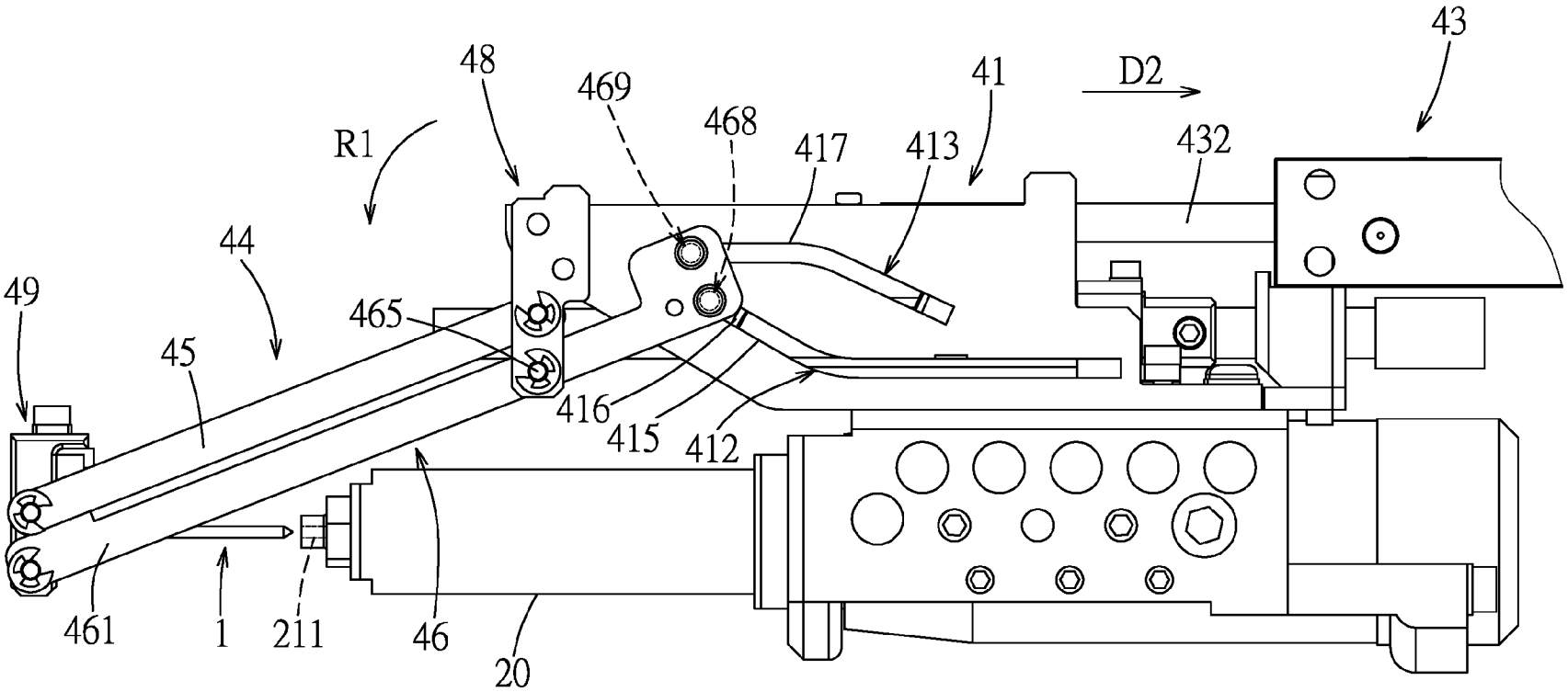
FIG. 10 is a schematic fragmentary side view illustrating the linkage mechanism at a first switch position.
Figure 12:
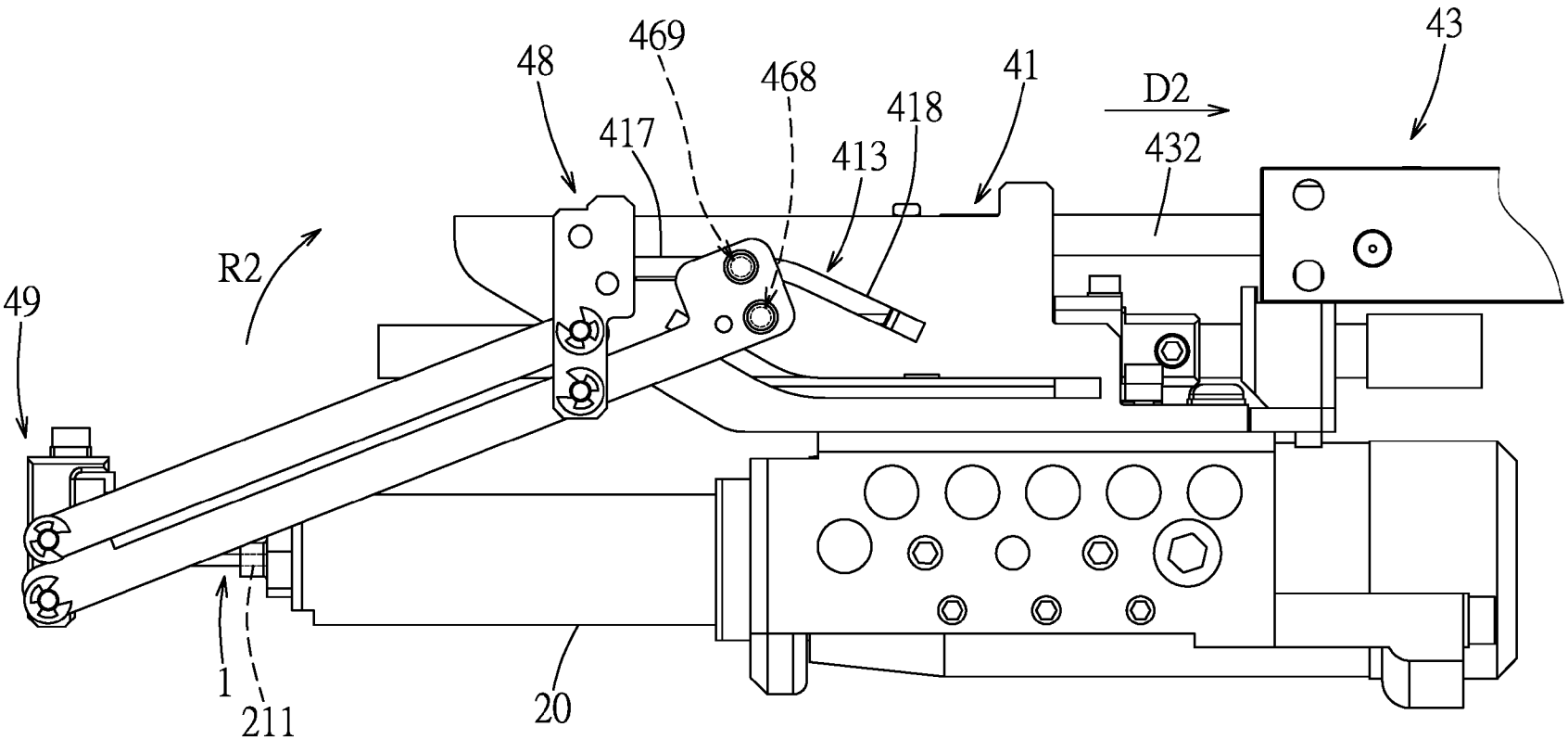
FIG. 12 is a schematic fragmentary side view illustrating the linkage mechanism at a second turning position.
Figure 14:
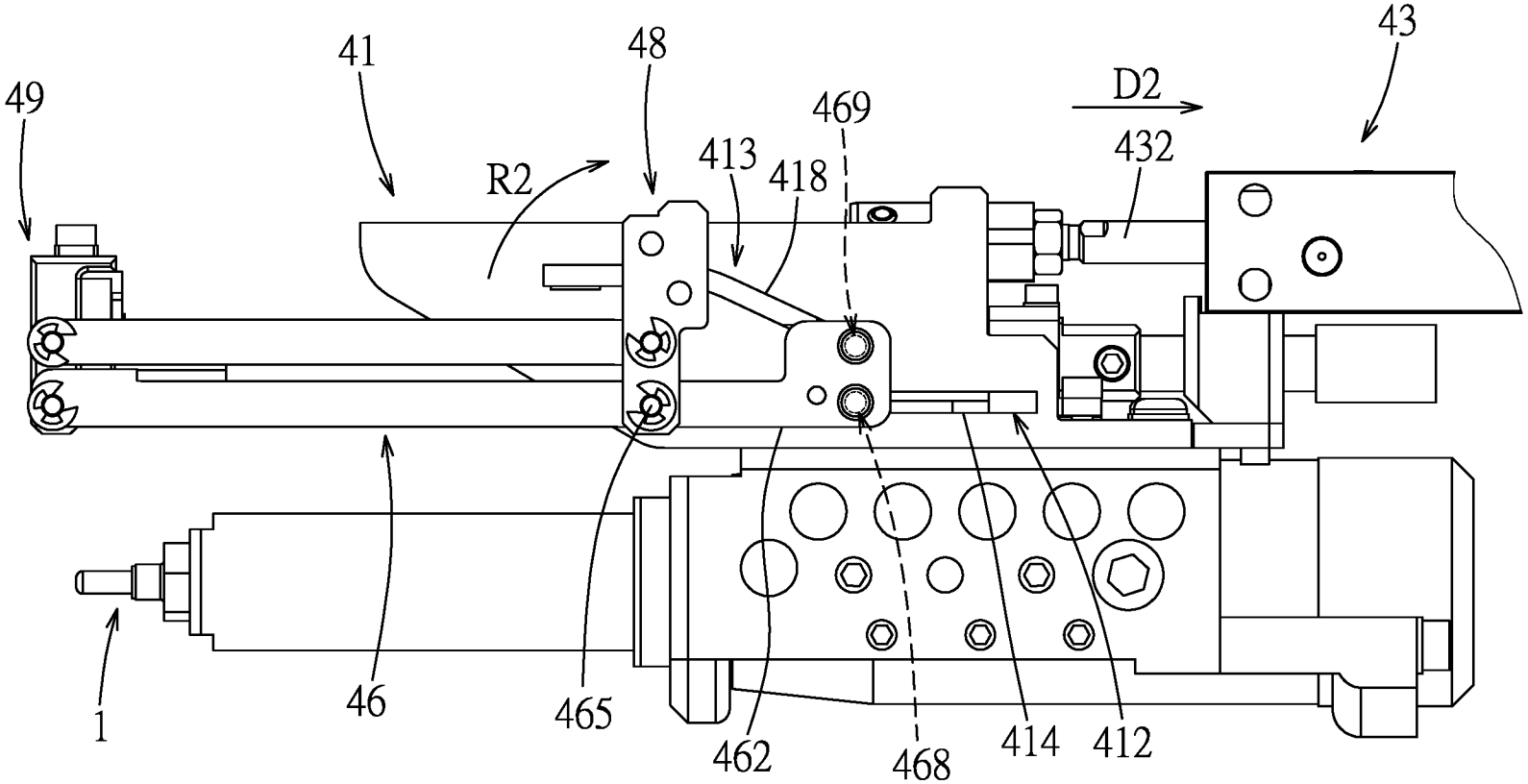
FIG. 14 is a schematic fragmentary side view illustrating the linkage mechanism at a second switch position.

FIG. 8 illustrates the linkage mechanism 44 at an initial position. FIG. 9 illustrates the linkage mechanism 44 at a first turning position. FIG. 10 illustrates the linkage mechanism 44 at a first switch position. FIG. 12 illustrates the linkage mechanism 44 at a second turning position. FIG. 14 illustrates the linkage mechanism 44 at a second switch position.

Referring to FIG. 8, when the linkage mechanism 44 is at the initial position, the first pin 468 of the lower link 46 is aligned with the first guide groove 412, and the second pin 469 of the lower link 46 is not aligned with the second guide groove 413. The first pin 468 engages the first horizontal groove portion 414 of the first guide groove 412 such that the lower link 46 is connected to the guide member 41 via the first pin 468. When the linkage mechanism 44 is at the initial position, the feed tube 3 conveys a fastener 1 (see FIG. 2) into the clamp assembly 49 so that the fastener 1 is held by the clamp assembly 49. Then, the rod 432 of the drive unit 43 is operated to move the slide member 48 in the first direction (D1). Since the first pin 468 engages the first horizontal groove portion 414 of the first guide groove 412, the movement of the first pin 468 is limited by the first horizontal groove portion 414. Therefore, when the rod 432 of the drive unit 43 is operated to move the slide member 48 in the first direction (D1), the linkage mechanism 44 as a whole moves horizontally relative to the guide member 41 along the first horizontal groove portion 414 (i.e., in the first direction (D1)).

Referring to FIG. 9, when the first pin 468 of the lower link 46 is moved to the intersection of the first horizontal groove portion 414 and the first inclined groove portion 415 of the first guide groove 412, the linkage mechanism is at the first turning position. The rod 432 of the drive unit 43 is operated to further move the slide member 48 in the first direction (D1), so that the first pin 468 enters and engages the first inclined groove portion 415 of the first guide groove 412 and moves forwardly and upwardly along the first inclined groove portion 415. During the movement of the first pin 468 within the first inclined groove portion 415, the lower link 46 is rotated relative the slide member 48 about the pivot bolt 465 in a first rotational direction (R1), such that the clamp assembly 49 is moved downwardly relative to the guide member 41.

Referring to FIG. 10, when the first pin 468 of the lower link 46 is moved to the distal end of the first inclined groove portion 415 of the first guide groove 412 and is pushed by the first guide surface 416 (see FIG. 11) to be disengaged from the first guide groove 412, the second pin 469 of the lower link 46 is aligned with the second guide groove 413, and engages the second horizontal groove portion 417 of the second guide groove 413. At this time, the linkage mechanism 44 is at the first switch position, where the first pin 468 of the lower link 46 is not engaged with the first guide groove 412, and the second pin 469 of the lower link 46 is engaged with the second guide groove 413. In other words, the lower link 46 is switched to connect to the guide member 41 via the second pin 469. In addition, when the linkage mechanism 44 is at the first switch position, the fastener 1 held by the clamp assembly 49 is aligned with the loading hole 211 of the gun body 20.

Figure 11:
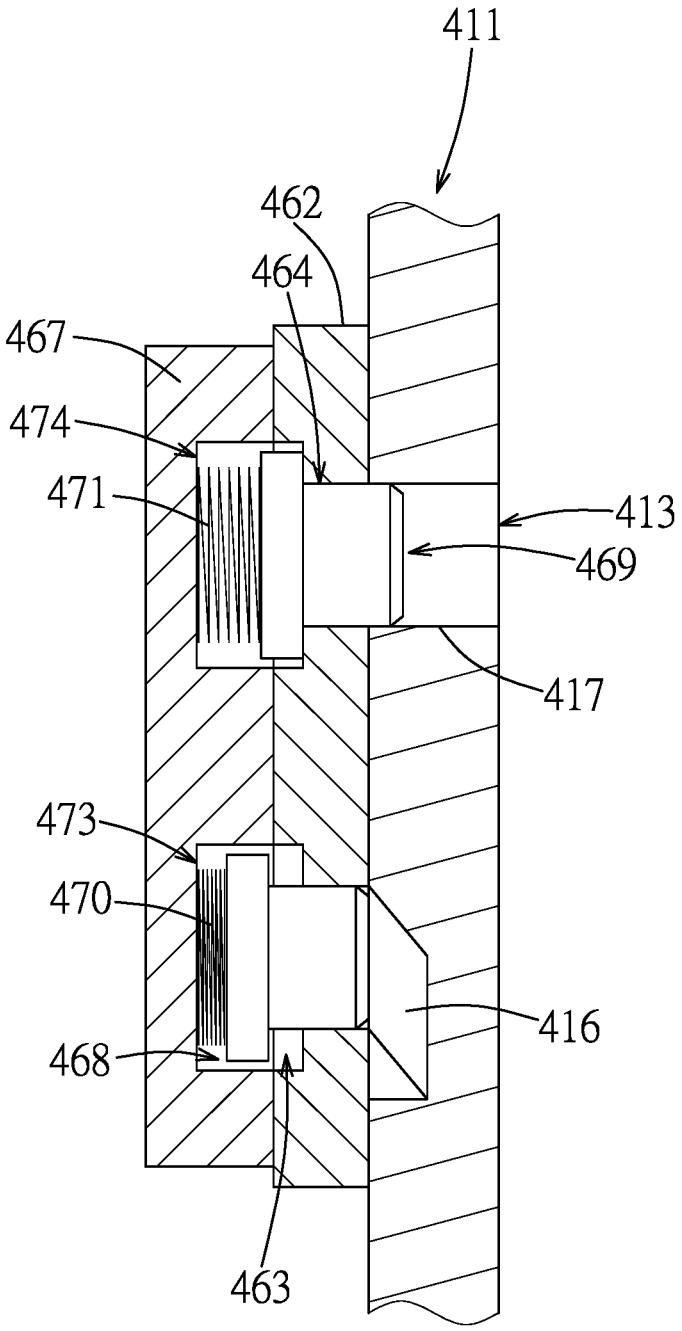
FIG. 11 is a schematic fragmentary sectional view illustrating a relationship between a first pin, a second pin, a first guide groove and a second guide groove when the linkage mechanism is at the first switch position.

Referring to FIG. 11, FIG. 11 illustrates a relationship between the first pin 468, the second pin 469, the first guide groove 412 and the second guide groove 413 when the linkage mechanism 44 is at the first switch position. When the first pin 468 is moved to the distal end of the first inclined groove portion 415 of the first guide groove 412, the first pin 468 is pushed by the first guide surface 416 to be disengaged from the first guide groove 412, and is biased by the first resilient member 470 to abut against the side surface of the lateral plate 411. At the same time, the second pin 469 is aligned with the second guide groove 413, and is biased be the second resilient member 471 to engage the second horizontal groove portion 417 of the second guide groove 413.

Referring further to FIG. 12, after the linkage mechanism 44 is moved to the first switch position such that the lower link 46 is engaged to the second guide groove 413 via the second pin 469, the rod 432 of the drive unit 43 is operated to move the slide member 48 in the second direction (D2). Since the second pin 469 engages the second horizontal groove portion 417 of the second guide groove 413, the movement of the second pin 469 is limited by the second horizontal groove portion 417. Therefore, when the rod 432 of the drive unit 43 is operated to move the slide member 48 in the second direction (D2), the linkage mechanism 44 as a whole moves horizontally relative to the guide member 41 along the second horizontal groove portion 417 (i.e., in the second direction (D2)), so that the clamp assembly 49 gradually inserts the fastener 1 into the loading hole 211 of the gun body 20.

Figure 13:
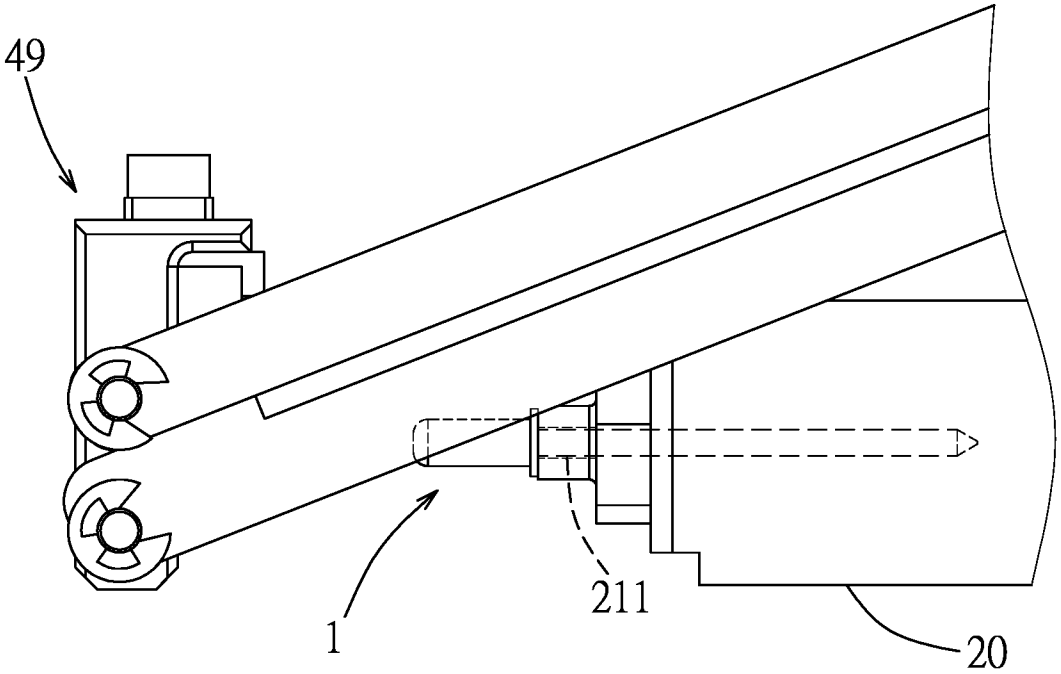
FIG. 13 is a schematic fragmentary side view illustrating a fastener being separated from the clamp assembly when the linkage mechanism is at the second turning position.

When the second pin 469 of the lower link 46 is moved to the intersection of the second horizontal groove portion 417 and the second inclined groove portion 418 of the second guide groove 413, the linkage mechanism 44 is at the second turning position, and the fastener 1 is partially inserted into the loading hole 211. Then, the fastener 1 is further drawn into the loading hole 211 by a suction force generated inside the loading hole 211, and is separated from the clamp assembly 49 (see FIG. 13).

When the linkage mechanism 44 is at the second turning position and when the fastener 1 is separated from the clamp assembly 49, the rod 432 of the drive unit 43 is operated to further move the slide member 48 in the second direction (D2), so that the second pin 469 enters and engages the second inclined groove portion 418 of the second guide groove 413 and moves rearwardly and downwardly along the second inclined groove portion 418. During the movement of the second pin 469 within the second inclined groove portion 418, the lower link 46 is rotated relative to the slide member 48 about the pivot bolt 465 in a second rotational direction (R2), such that the clamp assembly 49 is moved upwardly relative to the guide member 41.

Referring to FIG. 14, when the second pin 469 of the lower link 46 is moved to the distal end of the second inclined groove portion 418 of the second guide groove 413 and is pushed by the second guide surface 419 (see FIG. 15) to be disengaged from the second guide groove 413, the first pin 468 of the lower link 46 is aligned with the first guide groove 412, and engages the first horizontal groove portion 414 of the first guide groove 412. At this time, the linkage mechanism 44 is at the second switch position, where the first pin 468 of the lower link 46 is engaged with the first guide groove 412, and the second pin 469 of the lower link 46 is not engaged with the second guide groove 413. In other words, the lower link 46 is switched to connect to the guide member 41 via the first pin 468.

Figure 15:
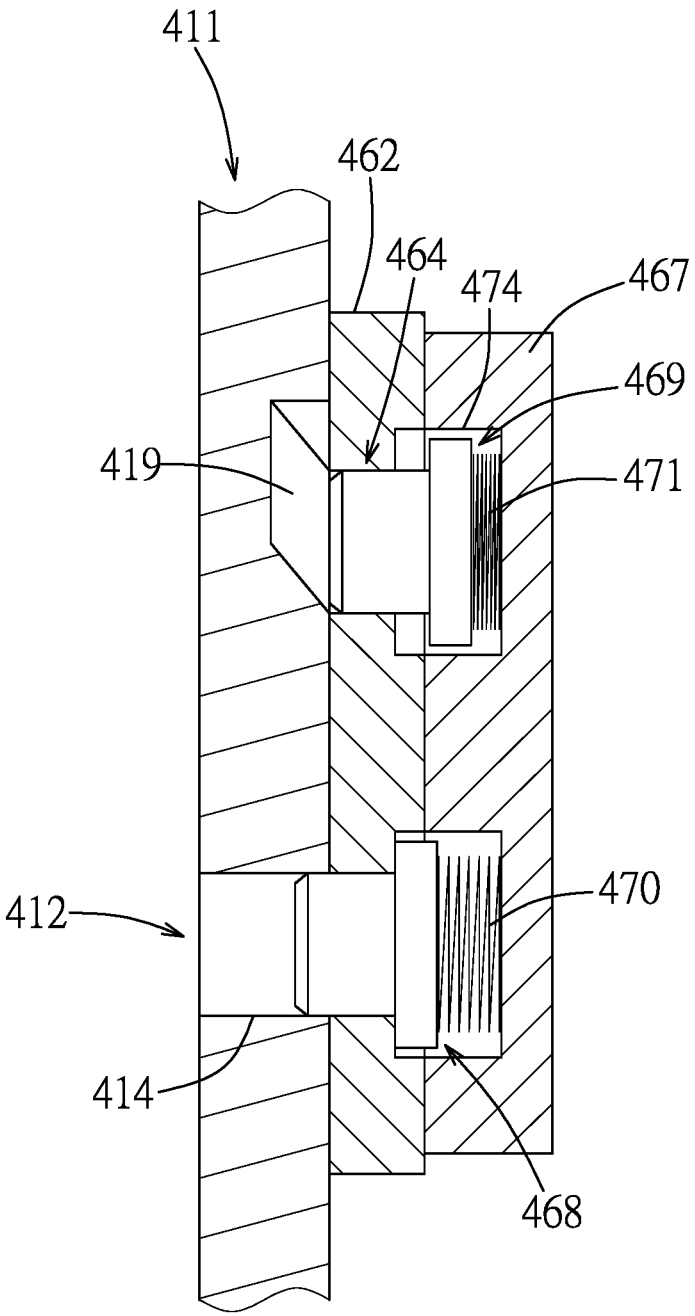
FIG. 15 is a schematic fragmentary sectional view illustrating a relationship between the first pin, the second pin, the first guide groove and the second guide groove when the linkage mechanism is at the second switch position.

Referring to FIG. 15, FIG. 15 illustrates a relationship between the first pin 468, the second pin 469, the first guide groove 412 and the second guide groove 413 when the linkage mechanism is at the second switch position. When the second pin 469 is moved to the distal end of the second inclined groove portion 418 of the second guide groove 413, the second pin 469 is pushed by the second guide surface 419 to be disengaged from the second guide groove 413, and is biased by the second resilient member 471 to abut against the side surface of the lateral plate 411. At the same time, the first pin 468 is aligned with the first guide groove 412, and is biased by the first resilient member 470 to engage the first horizontal groove portion 414 of the first guide groove 412.

After the linkage mechanism 44 is moved to the second switch position such that the lower link 46 is engaged to the first guide groove 412 via the first pin 468, the rod 432 of the drive unit 43 is operated to further move the slide member 48 in the second direction (D2), so as to move the linkage mechanism 44 back to the initial position, as shown in FIG. 8, for holding another fastener 1. A user is permitted to manipulate the fastener 1 with the gun body 20 after the linkage mechanism 44 is moved back to the initial position.

In one embodiment of the disclosure, the lateral plates 411 of the guide member 41 are machined by wire cutting and polishing, so that the side surface of each of the lateral plates 411 of the guide member 41 has a relatively low surface roughness so as to lower the abrasion of the first and second pins 468, 469, and to lengthen the service lives of the first and second pins 468, 469. In addition, since the first and second guide grooves 412, 413 are configured as through grooves, the first and second guide grooves 412, 413 can be machined simply by wire cutting without other complex machining processes, so as to reduce the cost and time for the machining operation thereof.

Figure 16:
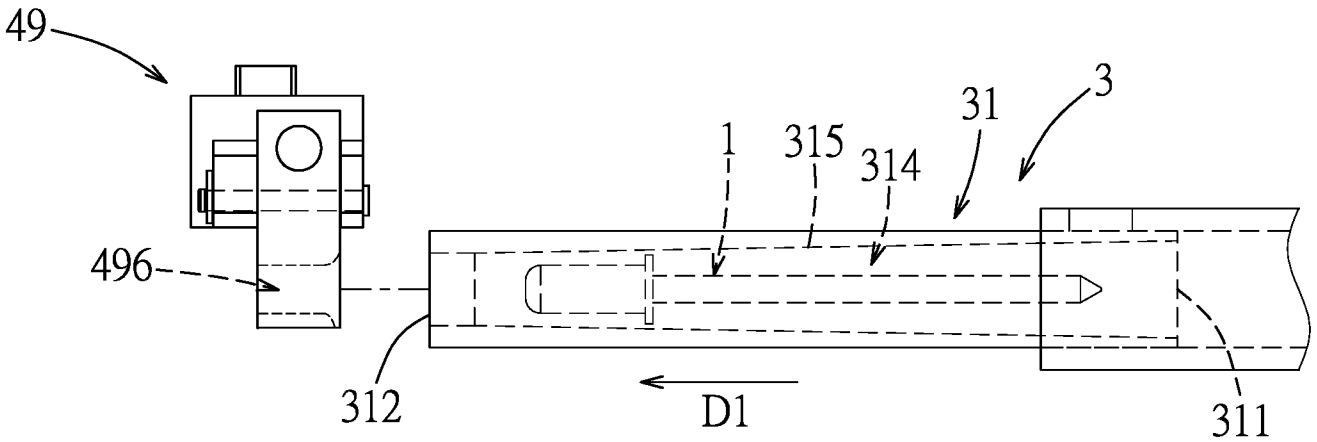
FIG. 16 is a schematic fragmentary side view illustrating the feed tube and the clamp assembly.

Referring to FIG. 16, FIG. 16 illustrates the feed tube 3 and the clamp assembly 49. The feed tube 3 includes a front tubular body 31 that has an inner surrounding surface 315 defining a convergent through hole 314. The convergent through hole 314 has opposite inlet and outlet openings 311, 312. The inlet opening 311 has a diameter greater than that of the outlet opening 312. The convergent through hole 314 converges from the inlet opening 311 toward the outlet opening 312. As such, during the movement of the fastener 1 in the convergent through hole 314 from the inlet opening 311 to the outlet opening 312, the fastener 1 is guided by the inner surrounding surface 315 to be accurately aligned with the clamping space 496 defined by the clamp assembly 49. In one embodiment, the fastener 1 is conveyed within the feed tube 3 by compressed air generated by a pneumatic mechanism (not shown), so as to be moved toward the clamp assembly 49.

Referring back to FIGS. 1 and 2, according to one embodiment of this disclosure, the fixing gun 2 further includes an outer shield 6 that is fixed to the base seat 40. The outer shield 6 has a retaining ring 63 for connection with a pulley 7. The fixing gun 2 is hanged on the pulley 7 by a rope 71 that extends through the retaining ring 63 of the outer shield 6, so as to be unlaboriously operated by a user.

Figure 17:
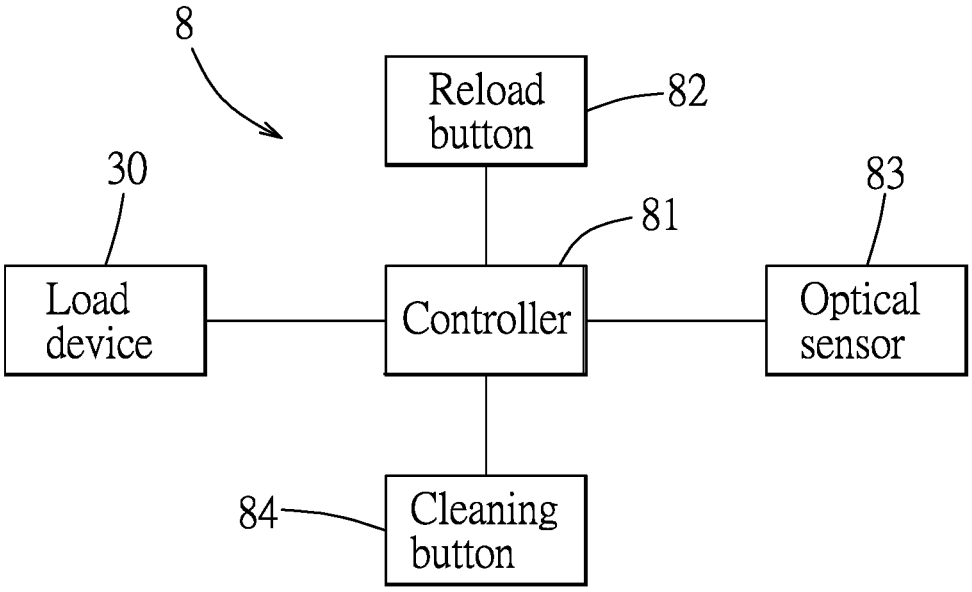
FIG. 17 is a block diagram illustrating a control unit of the embodiment.

Referring to FIG. 17, FIG. 17 is a block diagram illustrating a control unit 8 of the fixing gun 2. The control unit 8 includes a controller 81, a reload button 82, an optical sensor 83 and a cleaning button 84. The controller 81 is configured as a programmable logic controller that is electrically connected to the drive unit 43 of the loading device 30 for controlling the operation of the drive unit 43. The reload button 82 is electrically connected to the controller 81, such that the controller 81 is configured to activate the drive unit 43 to drive movement of the linkage mechanism 44 so as to load the gun body 20 with the fastener 1 upon depression of the reload button 82. The cleaning button 84 is electrically connected to the controller 81, such that the controller 81 is configured to activate the drive unit 43 to move the linkage mechanism 44 to a cleaning position for obviating unusual incidents during the operation of the loading device 30 upon depression of the cleaning button 84. In one embodiment, the controller 81 activates the drive unit 43 to move the linkage mechanism 44 to the first switch position (see FIG. 10) upon depression of the cleaning button 84, so that a major portion of the linkage mechanism 44 is exposed out of the outer shield 6 so as to facilitate obviation of unusual incidents during the operation of the loading device 30.

Referring to FIGS. 1 and 17, in one embodiment, the optical sensor 83 is electrically connected to the controller 81, and is disposed on the outer shield 6. The optical sensor 83 is for detecting if the moving path of the linkage mechanism 44 is obstructed by any object. In detail, the optical sensor 83 detects the presence of objects along a sensing path (P), and the loading hole 211 of the gun body 20 extends along an extending axis (A1). The sensing path (P) and the extending axis (A1) cooperatively form an angle (A) that is configured as an acute angle.

When the optical sensor 83 detects that there is no object located within a certain range (i.e., the moving path of the linkage mechanism 44), the optical sensor 83 generates a first sensing signal. The controller 81 permits the operation of the drive unit 43 upon reception of the first sensing signal from the optical sensor 83. When the optical sensor 83 detects an object located within the certain range, the optical sensor 83 generates a second sensing signal. The controller 81 prohibits the operation of the drive unit 43 upon reception of the second sensing signal from the optical sensor 83. As such, the linkage mechanism 44 is prevented from collision during the operation of the loading device 30.

To sum up, by virtue of the loading device 30 of the disclosure, the fastener 1 can be rapidly and accurately loaded in the gun body 20. By virtue of the configuration of the convergent through hole 314, the fastener 1 is guided to be accurately aligned with the clamping space 496 defined by the clamp assembly 49 during the transportation thereof within the feed tube 3, so as to allow the clamp assembly 49 to hold the fastener 1 adequately. By virtue of the optical sensor 83, the linkage mechanism 44 is prevented from collision during the operation of the loading device 30. By virtue of the cleaning button 84, the linkage mechanism 44 can be rapidly moved to an adequate position for obviation of unusual incidents during the operation of the loading device 30.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A fixing gun comprising:

a gun body adapted for manipulation of a fastener, said gun body having a loading hole; and a loading device disposed on said gun body and adapted for moving the fastener into said loading hole, said loading device including:

a guide member formed with a first guide groove and a second guide groove, and a linkage mechanism including a lower link, a slide member, and a clamp assembly adapted for holding the fastener, said slide member being disposed movably on said guide member, said lower link being pivotally coupled to said slide member and said clamp assembly; and wherein a first pin and a second pin extend through said lower link to respectively and alternatively engage said first guide groove and said second guide groove, and responsive to movement of said slide member relative to said guide member in a first direction, said lower link engages said first guide groove through said first pin and said second pin disengages with respect to said second guide groove, and responsive to movement of said slide member relative to said guide member in a second direction, said lower link engages said second guide groove through said second pin and said first pin disengages with respect to said first guide groove.

2. The fixing gun as claimed in claim 1, wherein said first and second guide grooves are formed through said guide member, and said first and second guide grooves are disconnected with respect to each other.

3. The fixing gun as claimed in claim 1, wherein said lower link is formed with a first through hole and a second through hole, and a connecting plate is coupled to said lower link and is formed with a first blind hole and a second blind hole, wherein said first and second pins are respectively and partially retained in said first and second blind holes and respectively extend through said first and second through holes.

4. The fixing gun as claimed in claim 1, wherein said first guide groove has a first guide surface located at a distal end of said first guide groove for pushing said first pin to thereby disengage said first pin from said first guide groove, and said second guide groove has a second guide surface located at a distal end of said second guide groove for pushing said second pin to thereby disengage said second pin from said second guide groove.

5. The fixing gun as claimed in claim 1, wherein said loading device further includes a feed tube, and said feed tube has a convergent through hole having opposite inlet and outlet openings, said inlet opening having a diameter greater than a diameter of said outlet opening.

6. The fixing gun as claimed in claim 1, further comprising an optical sensor for detecting the presence of an object located within a moving path of said linkage mechanism.

7. The fixing gun as claimed in claim 6, wherein said loading hole extends along an extending axis, and said optical sensor detects objects along a sensing path, wherein the extending axis and the sensing path cooperatively form an acute angle.

8. The fixing gun as claimed in claim 1, further comprising a cleaning button, and said linkage mechanism is moved to a cleaning position upon depression of said cleaning button.

9. A loading device adapted for use in a fixing gun, comprising:

a guide member formed with a first guide groove and a second guide groove; and a linkage mechanism movable relative to said guide member and including a lower link, a first pin and a second pin extending through said lower link, and said first and second pins respectively and alternatively engage said first and second guide grooves;

wherein responsive to said linkage mechanism being moved relative to said guide member in a first direction, said lower link engages said first guide groove through said first pin and said second pin disengages with respect to said second guide groove, and responsive to said linkage mechanism being moved relative to said guide member in a second direction, said lower link engages said second guide groove through said second pin and said first pin disengages with respect to said first guide groove.

10. The loading device as claimed in claim 9, wherein said first and second guide grooves are formed through said guide member, and said first and second guide grooves are disconnected with respect to each other.

11. The loading device as claimed in claim 9, wherein said first guide groove has a first guide surface located at a distal end of said first guide groove for pushing said first pin to thereby disengage said first pin from said first guide groove, and said second guide groove has a second guide surface located at a distal end of said second guide groove for pushing said second pin to thereby disengage said second pin from said second guide groove.

12. The loading device as claimed in claim 9, wherein said lower link is formed with a first through hole and a second through hole, and a connecting plate is coupled to said lower link and is formed with a first blind hole and a second blind hole, wherein said first and second pins are respectively and partially retained in said first and second blind holes and respectively extend through said first and second through holes.

13. The loading device as claimed in claim 9, further comprising a feed tube adapted to convey a fastener towards a clamp assembly of said linkage mechanism, wherein said clamp assembly is adapted to hold the fastener, and wherein said feed tube has a convergent through hole having opposite inlet and outlet openings, and said inlet opening having a diameter greater than a diameter of said outlet opening.

* * * * *